US005599178A

United States Patent [19]

Yuzaki et al.

[11] Patent Number: 5,599,178

[45] Date of Patent: Feb. 4, 1997

[54] SCROLL-TYPE COMPRESSOR HAVING FASTENING BOLTS FOR THE FIXED SCROLL

[75] Inventors: Tsuneo Yuzaki, Aichi; Masahiro Fukushima, Nagoya, both of Japan

[73] Assignee: Mitsubishi Jukogyo Kabushiki Kaisha, Japan

[21] Appl. No.: 502,901

[22] Filed: Jul. 17, 1995

[30] Foreign Application Priority Data

Sep. 1, 1994 [JP] Japan ..... 6-230204

[51] Int. Cl.[6] ..... F04C 18/04

[52] U.S. Cl. ..... 418/55.1; 29/888.022

[58] Field of Search ..... 418/55.1; 417/902; 29/888.022

[56] References Cited

U.S. PATENT DOCUMENTS 4,744,737 5/1988 Yamamura et al. ..... 418/55.1
5,312,234 5/1994 Yoshii ..... 418/55.1

FOREIGN PATENT DOCUMENTS 3-3988 1/1991 Japan ..... 418/55.1
6-81779 3/1994 Japan ..... 418/55.1

*Primary Examiner*—John J. Vrablik
*Attorney, Agent, or Firm*—Patterson & Streets, L.L.P.

[57] ABSTRACT

There is provided a scroll-type compressor in which a scroll-type compressing mechanism comprising a fixed scroll and an orbiting scroll, a motor, and a frame to which a main bearing is mounted to rotatably support a motor rotating shaft for driving the orbiting scroll are disposed in an enclosed housing composed of a plurality of housing members fastened by bolts, and the interior of the enclosed housing is divided into a high-pressure chamber and a low-pressure chamber by an end plate of the fixed scroll. The fixed scroll is fastened to the frame by making a plurality of holes passing through the frame in the frame, by inserting bolts into the holes from the side of the low-pressure chamber, and by screwing the bolts into the fixed scroll. Thereby, an adverse effect of thermal deformation or pressure deformation of the enclosed housing on a scroll-type compressing mechanism can be averted.

3 Claims, 3 Drawing Sheets

SCROLL-TYPE COMPRESSOR HAVING FASTENING BOLTS FOR THE FIXED SCROLL

FIELD OF THE INVENTION AND RELATED ART STATEMENT

The present invention relates to a scroll-type compressor.

One example of a scroll-type compressor relating to the present invention is shown in FIG. 3.

Referring to FIG. 3, an enclosed housing 4 consists of a right-hand cup-shaped member 49 and a left-hand cup-shaped member 43. A frame 5 is disposed within the enclosed housing 4 by fitting an engaging surface 5*a* of the flange 5 to the inner peripheral surface of the opening portion of the right-hand cup-shaped member 49, by holding an outer peripheral flange portion 5*b* of the frame 5 between a flange 49*a* of the right-hand cup-shaped member 49 and a flange 43*a* of the left-hand cup-shaped member 43, and by fastening these elements with bolts 56.

The right-hand cup-shaped member 49 has a motor, for example, an electric motor M, therein, while the left-hand cup-shaped member 43 has a scroll-type compressing mechanism C therein. The frame 5 is provided with a main bearing 52, a thrust bearing 53 for supporting a thrust load acting on an orbiting scroll 2 of the compressing mechanism C, and a rotation checking mechanism 6.

The electric motor M and the compressing mechanism C are connected to each other via a rotation shaft 3. The rotation shaft 3 is rotatably supported by a sub-bearing 51 and the main bearing 52.

The electric motor M consists of a rotor Ma and a stator Mb. The rotor Ma is fixed to the rotation shaft 3, and the stator Mb is press fitted and fixed to the right-hand cup-shaped member 49.

The scroll-type compressing mechanism C has a fixed scroll 1 and the orbiting scroll 2.

The fixed scroll 1 is provided with an end plate 11 and a spiral wrap 12 erected on the inner surface of the end plate 11. The end plate 11 is fastened to the left-hand cup-shaped member 43 with bolts 57.

The interior of the enclosed housing 4 is divided into two chambers by bringing the outer peripheral surface of the end plate 11 into contact with the inner peripheral surface of the left-hand cup-shaped member 43. A discharge chamber 46 is defined at the left of the end plate 11 in FIG. 3, and a suction chamber is defined at the right of the same. A discharge port 13, drilled at the center of the end plate 11, is opened/closed by a discharge valve 17.

The orbiting scroll 2 is provided with an end plate 21 and a spiral wrap 22 erected on the inner surface of the end plate 21. A drive bush 32 is rotatably fitted into a boss 23 erected on the outer surface of the end plate 21. An eccentric drive pin 31, disposed eccentrically in a protruding manner on the end surface of the rotation shaft 3, is slidably fitted into a slide groove 33 formed in the drive bush 32.

The spiral wrap 12 of the fixed scroll 1 and the spiral wrap 22 of the orbiting scroll 2 are off-centered with each other by an orbiting radius, and engaged with each other by sifting through an angle of 180°, by which a plurality of enclosed spaces 24 are formed between both scrolls 1 and 2.

When the electric motor M is driven, the orbiting scroll 2 is driven via the rotation shaft 3, the eccentric drive pin 31, a drive bush 32, and a boss 23, so that the orbiting scroll 2 orbits on a circle with the orbiting radius while its rotation is checked by the rotation checking mechanism 6.

Then, gas enters a low-pressure chamber 48 through a suction pipe 44 of the enclosed housing 4. This gas is sucked into the enclosed spaces 24 through a passage 58 provided at the outer periphery of the stator Mb, a gap between the stator Mb and the rotor Ma, a passage 54 provided in the frame 5, and the suction chamber 47. As the volume of the enclosed spaces 24 is decreased by the orbiting motion of the orbiting scroll 2, the gas reaches the central portion while being compressed, where the gas passes through the discharge port 13, pushes to open the discharge valve 17, and is discharged into the discharge chamber 46, flowing to the outside through a discharge pipe 45.

In the above-described scroll-type compressor, the fixed scroll 1 is fixed to the left-hand cup-shaped member 43 by allowing the bolts 57 to pass through the left-hand cup-shaped member 43 from the outside and by screwing the bolts 57 into the end plate 11 of the fixed scroll 1 and tightening them. Therefore, the centering of the fixed scroll 1 and orbiting scroll 2 and the gap control must always be performed via the enclosed housing 4.

The fixed scroll 1 and the orbiting scroll 2 should be assembled so that the tip end surfaces of the wraps 12 and 22 are in close contact with the inner surfaces of the end plates 21 and 22 with both of the scrolls 1,2 are off-centered with each other and engaged with each other by shifting through an angle of 180°. However, since there are various errors actually, the error of off-centering distance between the fixed scroll 1 and the orbiting scroll 2, the angular error with respect to the angle of 180°, and the gap between the tip end surface of wrap and the inner surface of end plate must be kept in a predetermined allowable range. These operations are called the centering and the gap control, described above.

Accordingly, the thermal deformation and pressure deformation of the enclosed housing 4 occurring during the operation of the compressor have an adverse effect on the scroll-type compressing mechanism C, resulting in the decrease in compressor performance and reliability.

Also, there is a possibility of gas leaking from the portion where the bolt 57 passes through the left-hand cup-shaped member 43.

OBJECT AND SUMMARY OF THE INVENTION

The present invention was made to solve the above problems. Accordingly, an object of the present invention is to provide a scroll-type compressor in which an adverse effect of thermal deformation and pressure deformation of an enclosed housing on a scroll-type compressing mechanism is averted, and the performance and reliability of compressor are ensured.

To achieve the above object, the present invention is configured as follows: In a scroll-type compressor in which a scroll-type compressing mechanism comprising a fixed scroll and an orbiting scroll, a motor, and a frame to which a main bearing is mounted to rotatably support a motor rotating shaft for driving the orbiting scroll are disposed in an enclosed housing composed of a plurality of housing members fastened by bolts, and the interior of the enclosed housing is divided into a high-pressure chamber and a low-pressure chamber by an end plate of said fixed scroll, (1) the fixed scroll is fastened to the frame by making a plurality of holes passing through the frame in the frame, by inserting bolts into the holes from the side of the low-pressure chamber, and by screwing the bolts into the fixed scroll, and (2) in the above item (1), an O-ring is disposed in a gap between the inner peripheral surface of the enclosed housing and the outer peripheral surface of the end plate of the fixed scroll to seal the gap.

In the present invention, the fixed scroll is fixed to the frame, and the outer peripheral surface of the end plate of the fixed scroll is not in direct contact with the enclosed housing. Therefore, the thermal deformation and the pressure deformation of the enclosed housing do not have an adverse effect on the scroll-type compressing mechanism.

Also, gas does not leak from the portion where the bolts passes through the frame.

DETAILED DESCRIPTION OF PREFERRED EMBODIMENTS

Preferred embodiments of the present invention will be described typically in detail below with reference to the drawings.

Figure 1:
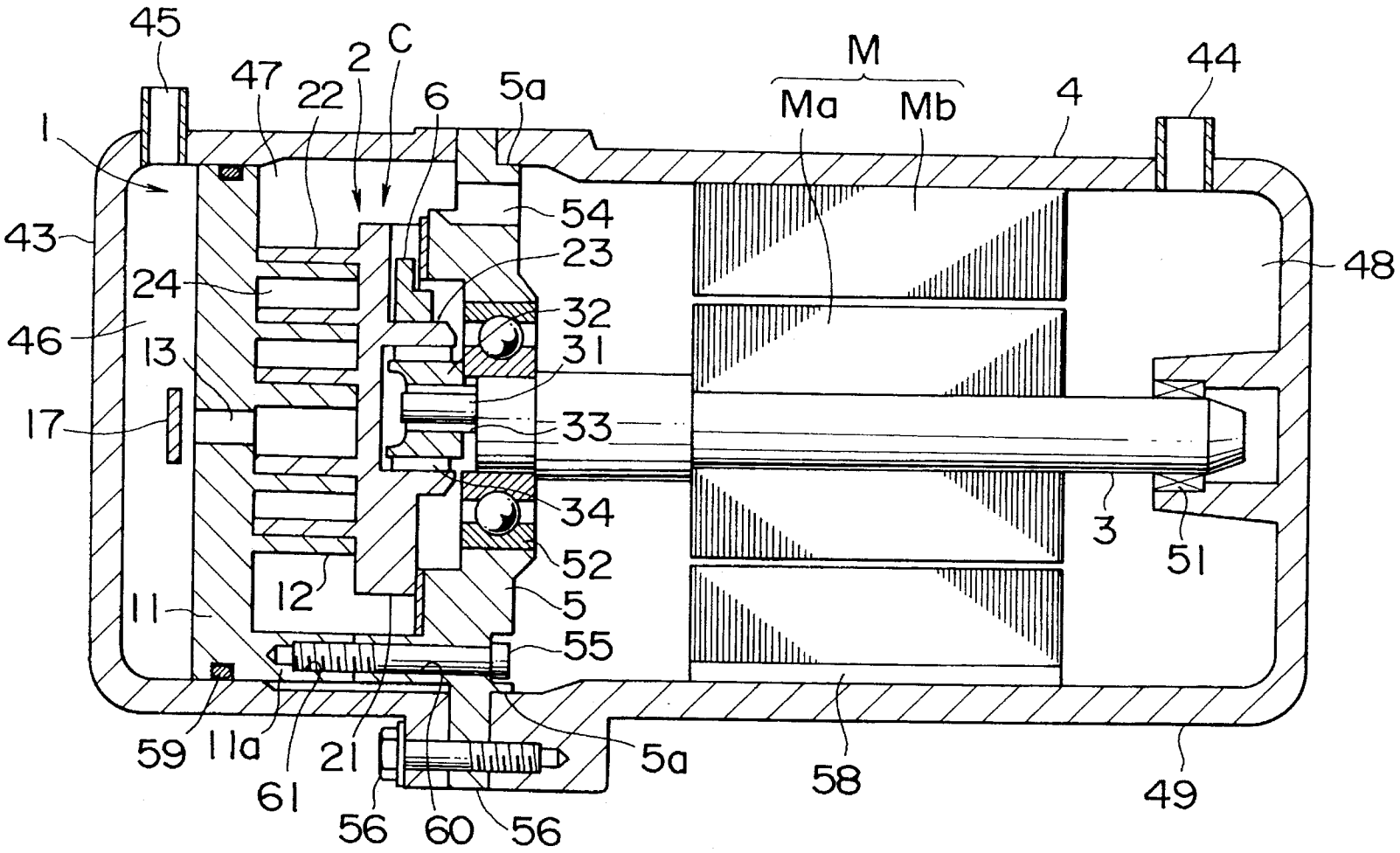
FIG. 1 is a longitudinal sectional view showing a first embodiment of the present invention.
Figure 3:
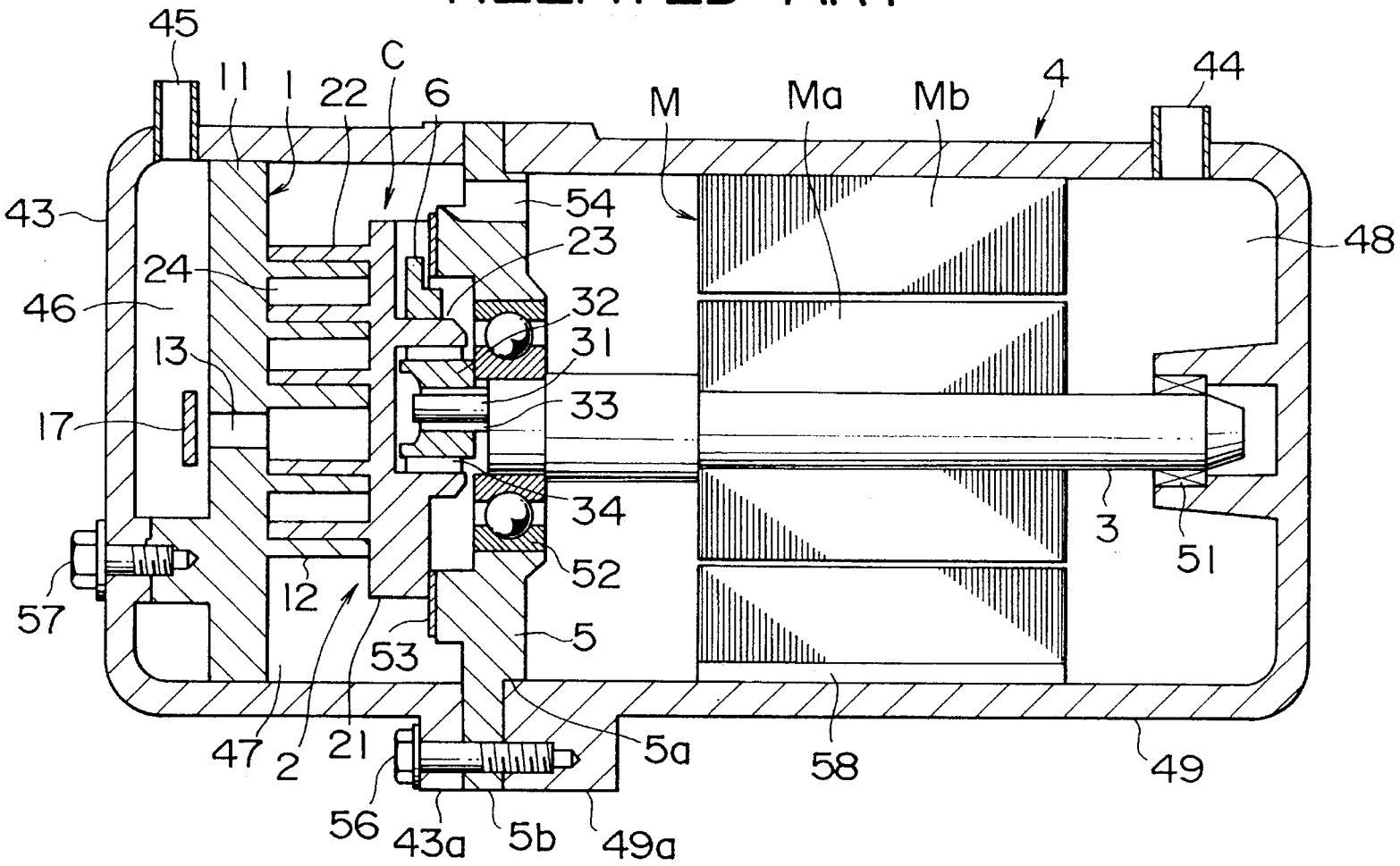
FIG. 3 RELATED ART
FIG. 3 is a longitudinal sectional view of a scroll-type compressor related to the present invention.

In FIG. 1, which shows a first embodiment of the present invention, the same reference numerals are applied to the same elements as those in FIG. 3, and the explanation is omitted.

As shown in FIG. 1, a boss portion 11*a* protruding inward is provided at the outer periphery on the inner surface of the end plate 11 of the fixed scroll 1. The fixed scroll 1 is fastened to the frame 5 by screwing bolts 55 into threaded holes 61 formed at a plurality of places, for example, three places, of the boss portion 11*a* from the right of the frame 5 (from the side of the low-pressure chamber 48) through bolt holes, for example three in number, formed in the frame 5.

In addition, an O-ring 59 is interposed between the outer peripheral surface of the end plate 11 of the fixed scroll 1 and the inner peripheral surface of the left-hand cup-shaped member 43 to seal the gap therebetween.

As described above, the fixed scroll 1 is fixed to the frame 5, and the O-ring 59 is interposed between the outer peripheral surface of the end plate 11 of the fixed scroll 1 and the inner peripheral surface of the left-hand cup-shaped member 43. Therefore, even if thermal deformation or pressure deformation occurs on the enclosed housing 4, such deformation does not have an adverse effect on the compressing mechanism C.

The suction chamber 47 at the left of the frame 5 and the low-pressure chamber 48 at the right, being in communication with each other, have a low pressure, and the bolts 55 are screwed from the right side of the frame 5. Therefore, gas does not leak through the bolt holes 60 of the frame 5, so that the O-ring for preventing gas leakage is not needed.

Since the bolts 57 passing through the left-hand cup-shaped member 43 are not needed, gas does not leak through the gap at the portion where the bolt 57 passes through.

The operation of the scroll-type compressor of this embodiment is the same as that of the compressor shown in FIG. 3.

Figure 2:
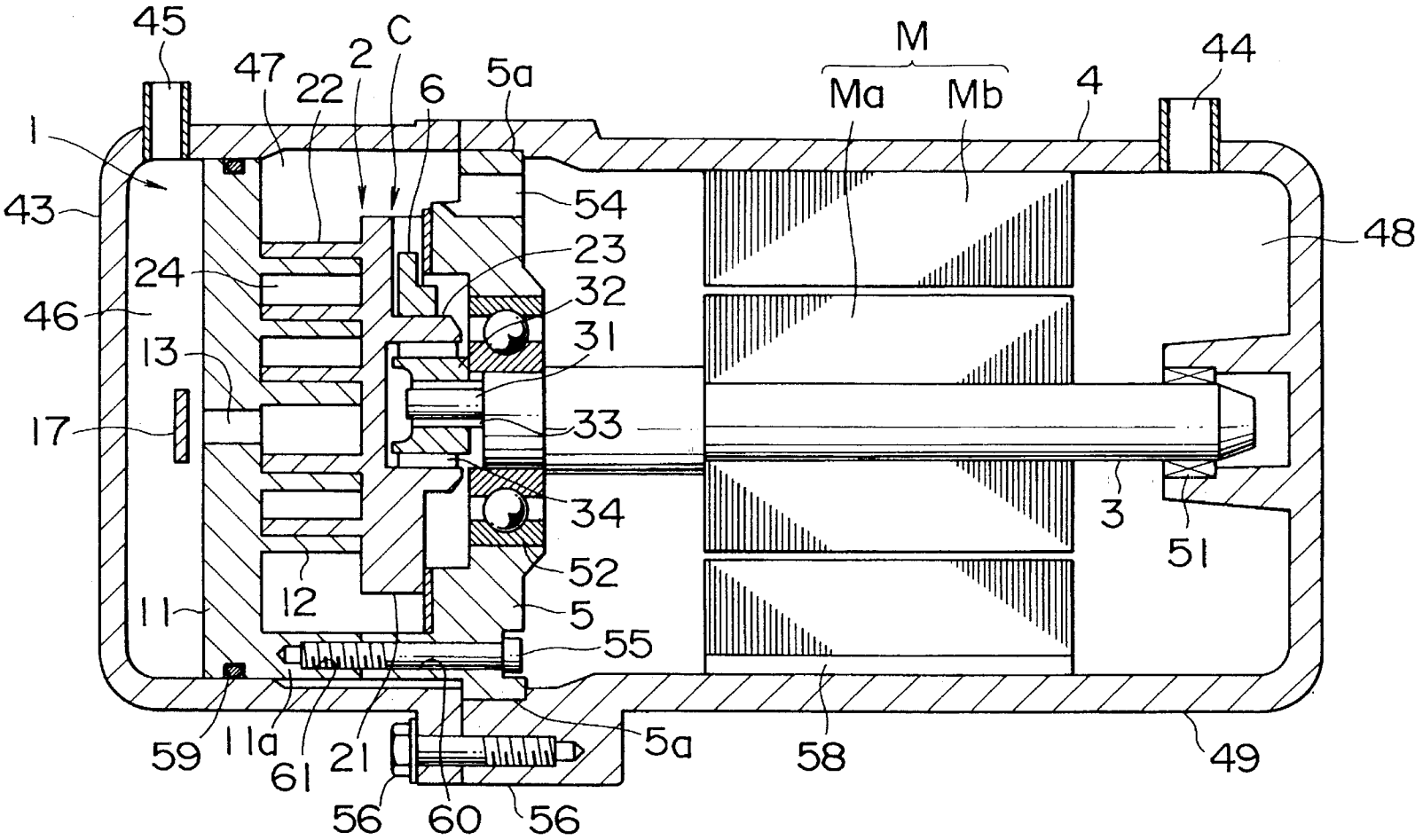
FIG. 2 is a longitudinal sectional view showing a second embodiment of the present invention.

FIG. 2 shows a second embodiment of the present invention.

In the second embodiment, the frame 5 is fixed to the opening portion of the right-hand cup-shaped member 49 by shrinkage fitting the engaging surface 5*a* at the outer periphery of the frame 5 into the right-hand cup-shaped member 49.

Other configurations of this embodiment is the same as that of the first embodiment shown in FIG. 1.

In the present invention described above, the fixed scroll is fastened to the frame by inserting and screwing the bolts passing through the frame into the fixed scroll from the low-pressure chamber side, which eliminates the adverse effect of thermal deformation or pressure deformation of the enclosed housing on the scroll-type compressing mechanism. Specifically, the thermal deformation and the pressure deformation of the enclosed housing does not result in the decreased assembly accuracy of the compressing mechanism such as the shifted angle of the fixed scroll and the orbiting scroll and the gap between the tip end of the wrap and the inner surface of the end plate. Therefore, the compressor performance and reliability can be ensured.

Since the fixed scroll is positioned directly with respect to the frame, the centering and the gap control are easy. Also, since the bolts passing through the enclosed housing can be disused, the possibility of gas leaking from the portion where the bolt passes through can be eliminated.

Further, since the bolts for fastening the fixed scroll are screwed by passing through the frame, the gas leakage through the gap between the fastening bolt and the bolt hole in the frame does not occur. Therefore, an O-ring or the like for preventing gas leakage is not needed at the fastening portion.

We claim:

1. A scroll-type compressor having fastening bolts for a fixed scroll including an enclosed housing having a pair of cup-shaped members having a flange at each open portion of said cup-shaped members, a frame having two opposed sides, said frame held in said enclosed housing by the flanges of said pair of cup-shaped members, a rotary shaft rotatably held at said frame, a motor housed in said enclosed housing at one side of said frame and connected to said rotary shaft, and a scroll-type compressing mechanism including an orbiting scroll connected to said rotary shaft and a fixed scroll engaging with said orbiting scroll;

said scroll-type compressor comprising an end plate of said fixed scroll being adapted to divide the inside of said enclosed housing into a high-pressure chamber and a low-pressure chamber, said high-pressure chamber serving as a discharge chamber, and said fixed scroll being fastened to said frame by screwing bolts into said fixed scroll, said bolts being inserted from the side of said frame facing the motor and extending into the fixed scroll, said fixed scroll being located in the low-pressure chamber.

2. A scroll-type compressor having fastening bolts for the fixed scroll, according to claim 1, wherein an O-ring is so disposed in a gap between the inner peripheral surface of said enclosed housing and the outer peripheral surface of said end plate of said fixed scroll as to seal said gap.

3. A scroll-type compressor having fastening bolts for the fixed scroll, according to claim 1, wherein a boss portion is provided in the direction of a wrap at the outer periphery of the end plate of said fixed scroll, threaded holes are formed in said boss portion, and bolts are screwed into said threaded holes and fastened therein.

* * * * *